US012735817B2

(12) United States Patent
Anderson et al.

(10) Patent No.: US 12,735,817 B2
(45) Date of Patent: Sep. 15, 2026

(54) KNIT FABRICS CONTAINING COPPER FILAMENTS AND METHODS OF MAKING SAME

(71) Applicant: 3M INNOVATIVE PROPERTIES COMPANY, St. Paul, MN (US)

(72) Inventors: Timothy J. Anderson, Savage, MN (US); Jay A. Esch, River Falls, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 550 days.

(21) Appl. No.: 17/911,186

(22) PCT Filed: Apr. 12, 2021

(86) PCT No.: PCT/IB2021/053013
§ 371 (c)(1),
(2) Date: Sep. 13, 2022

(87) PCT Pub. No.: WO2021/220093
PCT Pub. Date: Nov. 4, 2021

(65) Prior Publication Data

US 2023/0160112 A1 May 25, 2023

Related U.S. Application Data

(60) Provisional application No. 63/039,618, filed on Jun. 16, 2020, provisional application No. 63/016,380, filed on Apr. 28, 2020.

(51) Int. Cl.
*D04B 1/14* (2006.01)

(52) U.S. Cl.
CPC ..... *D04B 1/14* (2013.01); *D10B 2101/20* (2013.01); *D10B 2401/06* (2013.01); *D10B 2403/0241* (2013.01)

(58) Field of Classification Search
CPC . D04B 1/14; D04B 1/04; D04B 21/12; D10B 2101/20; D10B 2403/0241; C22F 1/10
(Continued)

(56) References Cited

U.S. PATENT DOCUMENTS 10,184,194 B2 1/2019 Henry et al.
2003/0074879 A1 4/2003 Patrick
(Continued)

FOREIGN PATENT DOCUMENTS

DE 20220752 U1 3/2004
EP 2584080 A2 4/2013
(Continued)

OTHER PUBLICATIONS

Ceken et al., The electromagnetic shielding properties of some conductive knitted fabrics produced on single or double needle bed of a flat knitting machine, The Journal of the Textile Institute, vol. 103, No. 9, Sep. 2012, pp. 968-979.(2012).*
(Continued)

*Primary Examiner* — Camie S Thompson
(74) *Attorney, Agent, or Firm* — Adrian L. Pishko

(57) ABSTRACT

The present disclosure provides a knit fabric including at least one continuous copper filament formed into a knit fabric including a layer of knit copper fabric having a first major plane and at least one loop of copper filament extending out of the first major plane. A knit fabric is also provided that has an interlock pattern including at least two continuous copper filament paths per layer. A further knit fabric is provided that includes a spacer fabric knit having a first layer of knit copper fabric interconnected with a second layer of knit copper fabric. Methods of making the knit fabrics are provided, including twisting or wrapping at least one continuous copper filament with a load-carrying yarn. The load-carrying yarn exhibits a minimum bend radius that
(Continued)

wraps around an object having a diameter of 0.43 millimeters. The methods further include setting at least one tension setting on a knitting machine and using a knitting program that defines a plurality of stitch settings to knit a fabric.

19 Claims, 13 Drawing Sheets

(58) Field of Classification Search
USPC ..... 442/316
See application file for complete search history.

(56) References Cited

U.S. PATENT DOCUMENTS

| | | | |
|---|---|---|---|
| 2007/0214765 | A1 | 9/2007 | Teshima et al. |
| 2008/0032580 | A1 | 2/2008 | Fukuoka et al. |
| 2016/0369436 | A1 | 12/2016 | Stewart et al. |
| 2017/0218542 | A1 | 8/2017 | Stewart et al. |

FOREIGN PATENT DOCUMENTS

| | | | |
|---|---|---|---|
| JP | 5241194 | U | 3/1977 |
| KR | 200185888 | Y1 | 6/2000 |
| KR | 20180115487 | A | 10/2018 |
| WO | 1993024689 | A1 | 12/1993 |
| WO | 2010013108 | A1 | 2/2010 |
| WO | 2010134762 | A2 | 11/2010 |
| WO | 2019012916 | A1 | 1/2019 |

OTHER PUBLICATIONS

International Search Report for PCT International Application No. PCT/IB2021/053013, mailed on Aug. 11, 2021, 8 pages.
Partial International Search for PCT International Application No. PCT/IB2021/053013, mailed on Jun. 18, 2021, 13 pages.

* cited by examiner

KNIT FABRICS CONTAINING COPPER FILAMENTS AND METHODS OF MAKING SAME

BACKGROUND

Knitting processes involve the formation of interconnected loops. To survive the knitting process, a yarn or filament must be strong enough to withstand the force of the needle, and flexible enough to bend to the bending radius of the needle. Although copper has high thermal and electrical conductivity, making it well suited for thermal applications in heat management, it may not survive certain knitting processes.

SUMMARY

In a first aspect, a knit fabric is provided. The knit fabric includes at least one continuous copper filament formed into a knit fabric. The knit fabric includes a layer of knit copper fabric having a first major plane, wherein the fabric has 5 to 18 loops per inch; and at least one loop of copper filament extending out of the first major plane such that the loop of copper filament and the first major plane of the knit copper fabric form an angle between 15 and 165 degrees.

In a second aspect, another knit fabric is provided. The knit fabric has an interlock pattern including at least two continuous copper filament paths per layer.

In a third aspect, a further knit fabric is provided. The knit fabric includes a spacer fabric knit having a first layer of knit copper fabric interconnected with a second layer of knit copper fabric.

In a fourth aspect, a method of making a knit fabric is provided. The method includes twisting or wrapping at least one continuous copper filament with a load-carrying yarn; setting at least one tension setting on a knitting machine; and using a knitting program that defines a plurality of stitch settings, knitting a fabric. The load-carrying yarn exhibits a minimum bend radius that wraps around an object having a diameter of 0.43 millimeters. The fabric includes a layer of knit copper fabric having a first major plane wherein the fabric has 5 to 18 loops per inch; and at least one loop of copper filament extending out of the first major plane such that the loop of copper filament and the first major plane of the knit copper fabric form an angle between 15 and 165 degrees.

In a fifth aspect, another method of making a knit fabric is provided. The method includes twisting or wrapping at least one continuous copper filament with a load-carrying yarn; setting at least one tension setting on a knitting machine; and using a knitting program that defines a plurality of stitch settings, knitting a fabric. The load-carrying yarn exhibits a minimum bend radius that wraps around an object having a diameter of 0.43 millimeters. The fabric includes either an interlock knit pattern consisting of two layers knitted on opposite beds with a connecting layer of rib knitted loops between them, or a spacer fabric that includes two knitted layers connected by a tucked layer.

The methods enable the formation of such knit fabrics using small gauge copper filaments that typically break when subjected to bending and knitting forces required to form knit fabrics that have structures other than a planar layer.

The above summary of the present disclosure is not intended to describe each disclosed embodiment or every implementation of the present disclosure. The description that follows more particularly exemplifies illustrative embodiments. In several places throughout the application, guidance is provided through lists of examples, which examples can be used in various combinations. In each instance, the recited list serves only as a representative group and should not be interpreted as an exclusive list.

Figure 1:
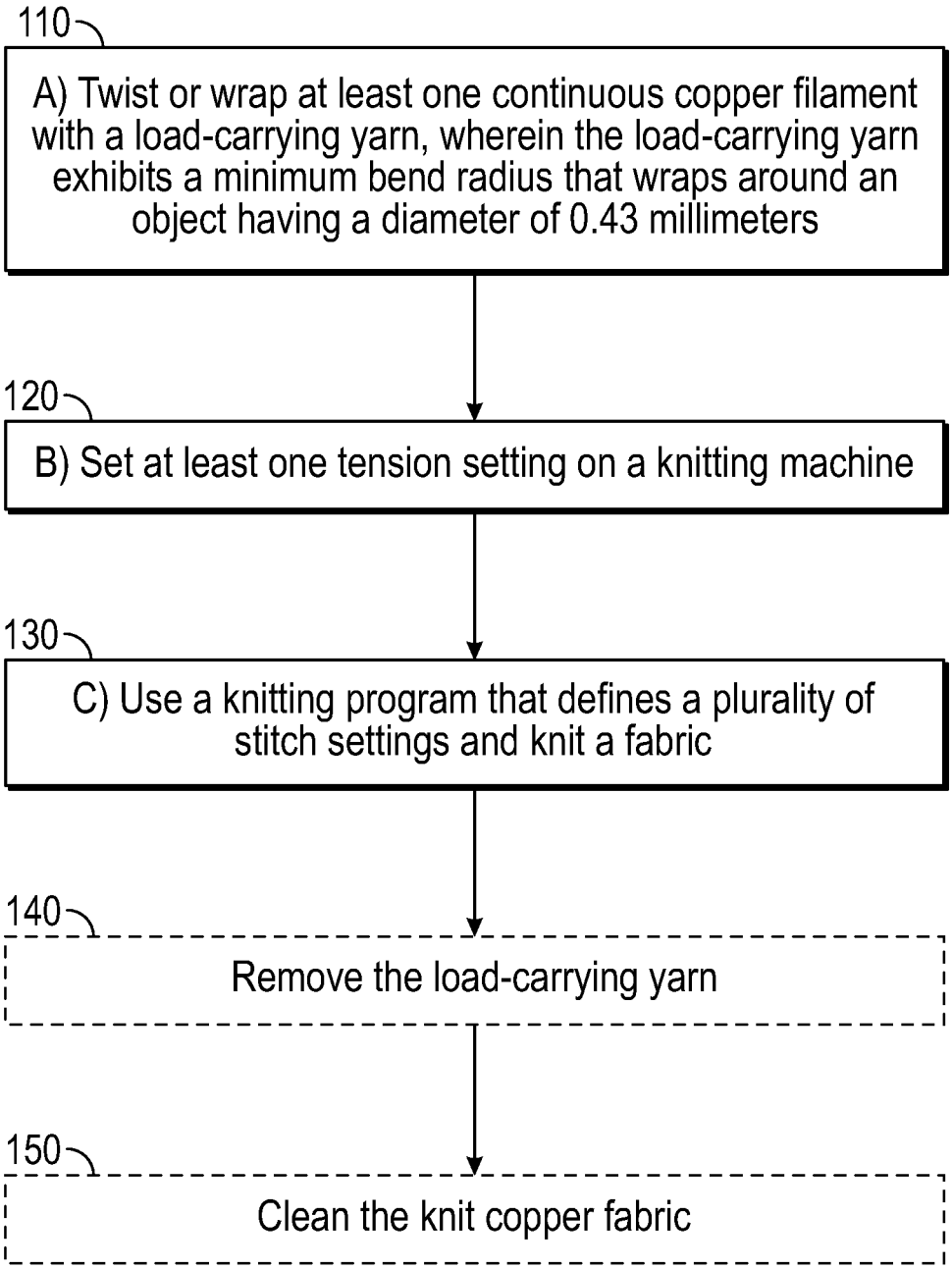
FIG. 1 is a generalized process flow diagram of a method of making a knit fabric according to the present disclosure.
Figure 2A:
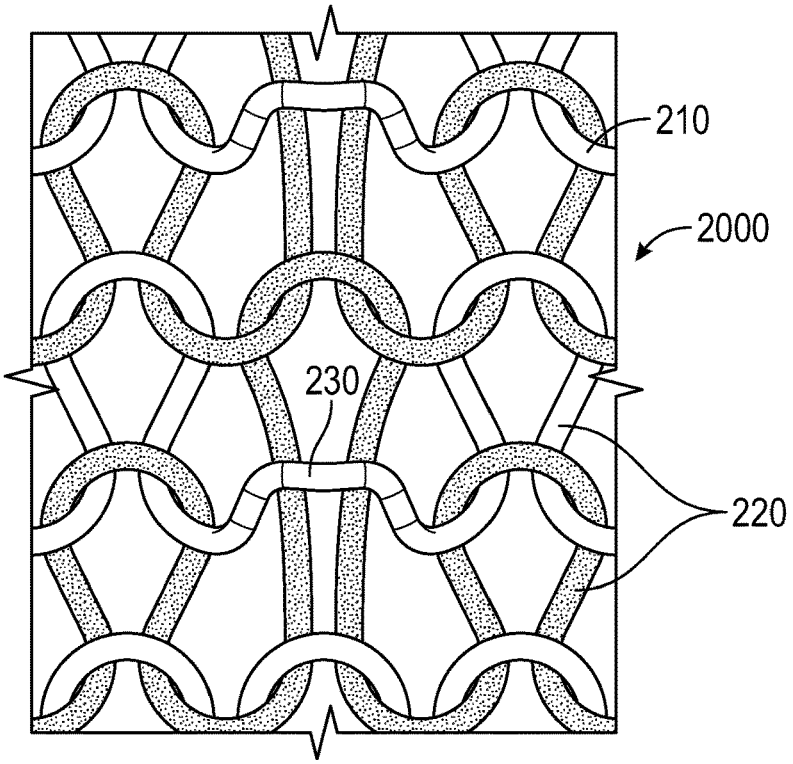
FIG. 2A is a schematic top view of an exemplary knit fabric, preparable according to the present disclosure.
Figure 2B:
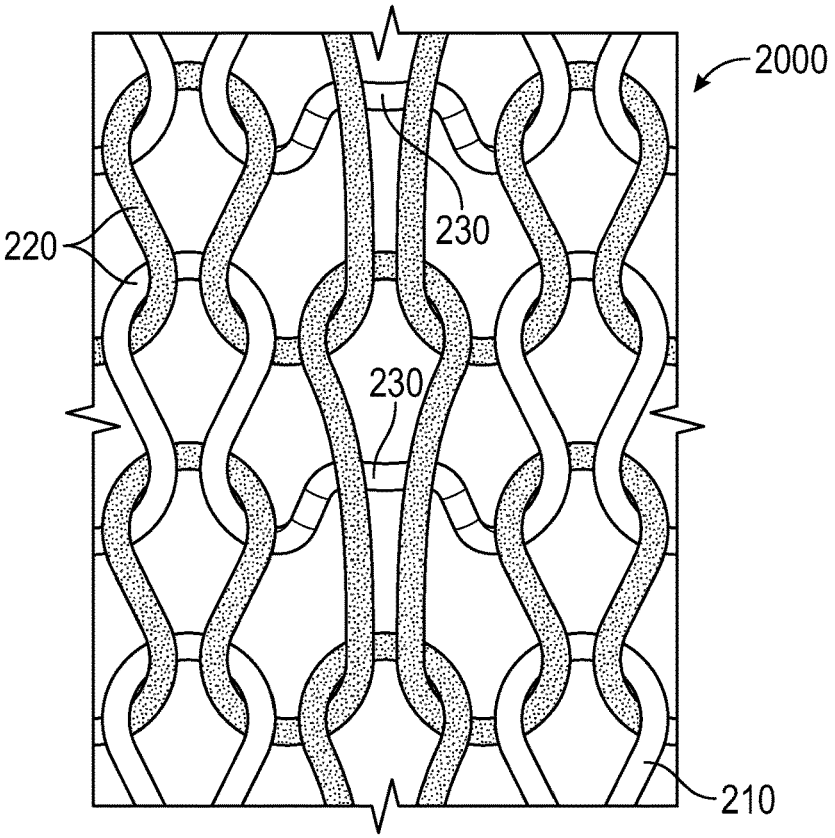
FIG. 2B is a schematic bottom view of the exemplary knit fabric of FIG. 2A.
Figure 2C:
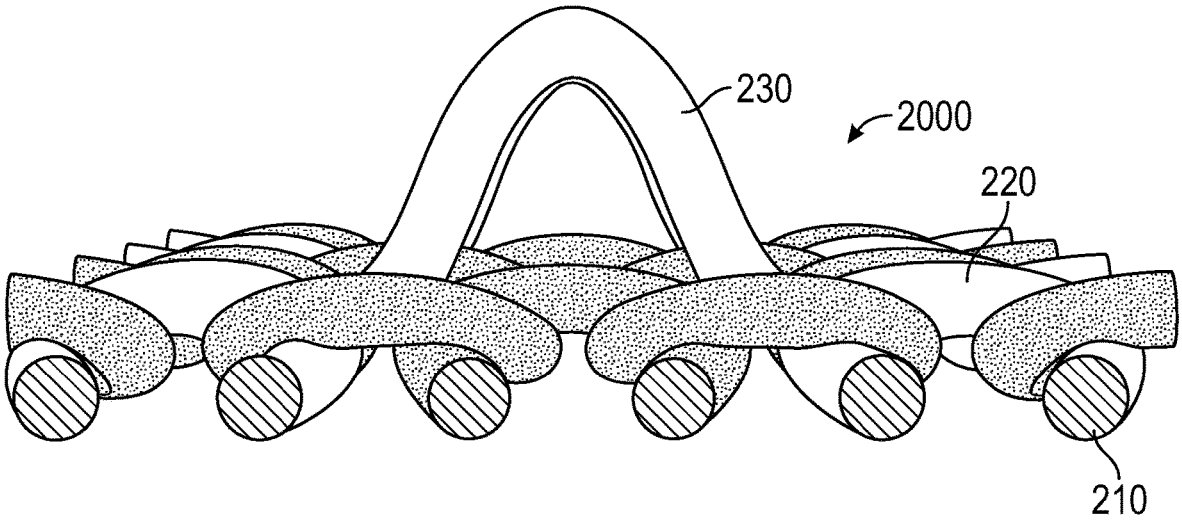
FIG. 2C is a schematic front view of the exemplary knit fabric of FIG. 2A.
Figure 2D:
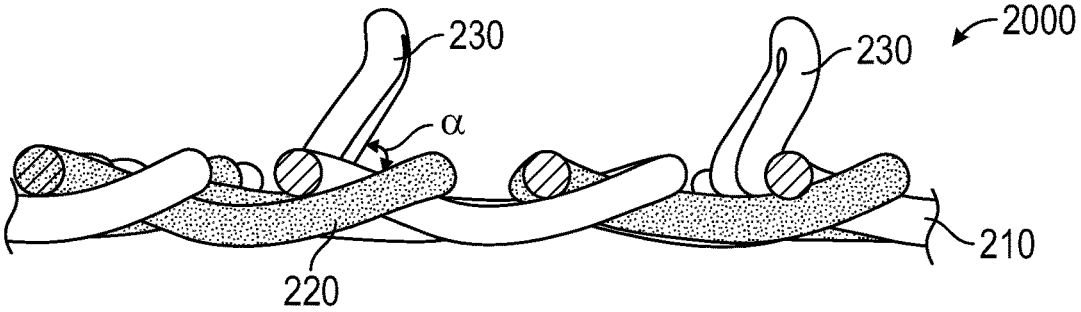
FIG. 2D is a schematic side view of the exemplary knit fabric of FIG. 2A.

Repeated use of reference characters in the specification and drawings is intended to represent the same or analogous features or elements of the disclosure. It should be understood that numerous other modifications and embodiments can be devised by those skilled in the art, which fall within the scope and spirit of the principles of the disclosure. The figures may not be drawn to scale.

DETAILED DESCRIPTION

The words "preferred" and "preferably" refer to embodiments of the disclosure that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure.

In this application, terms such as "a", "an", and "the" are not intended to refer to only a singular entity, but include the general class of which a specific example may be used for illustration. The terms "a", "an", and "the" are used interchangeably with the term "at least one." The phrases "at least one of" and "comprises at least one of" followed by a list refers to any one of the items in the list and any combination of two or more items in the list.

As used herein, the term "or" is generally employed in its usual sense including "and/or" unless the content clearly dictates otherwise.

The term "and/or" means one or all of the listed elements or a combination of any two or more of the listed elements.

Also herein, all numbers are assumed to be modified by the term "about" and preferably by the term "exactly." As used herein in connection with a measured quantity, the term "about" refers to that variation in the measured quantity as would be expected by the skilled artisan making the measurement and exercising a level of care commensurate with the objective of the measurement and the precision of the measuring equipment used. Also herein, the recitations of numerical ranges by endpoints include all numbers subsumed within that range as well as the endpoints (e.g., 1 to 5 includes 1, 1.5, 2, 2.75, 3, 3.80, 4, 5, etc.).

As used herein as a modifier to a property or attribute, the term "generally", unless otherwise specifically defined, means that the property or attribute would be readily recognizable by a person of ordinary skill but without requiring absolute precision or a perfect match (e.g., within +/−20% for quantifiable properties). The term "substantially", unless otherwise specifically defined, means to a high degree of approximation (e.g., within +/−10% for quantifiable properties) but again without requiring absolute precision or a perfect match. Terms such as same, equal, uniform, constant, strictly, and the like, are understood to be within the usual tolerances or measuring error applicable to the particular circumstance rather than requiring absolute precision or a perfect match.

As used herein, "continuous" with respect to a filament or a yarn means that the filament or yarn has an aspect ratio (e.g., a ratio of length to diameter) of greater than 10,000, and typically 10,000,000 or less.

As used herein, "discontinuous", with respect to a fiber or collection of fibers of a filament or a yarn, means fibers having a finite aspect ratio of less than 10,000.

As used herein, "knit fabric" means a layer or cloth having interlocking loops of at least one filament or yarn.

As used herein, "S twist" with respect to a filament or a yarn means that the filament or the yarn is spun counterclockwise.

As used herein, "Z twist" with respect to a filament or a yarn means that the filament or the yarn is spun clockwise.

As used herein, "solvent" refers to a nonreactive liquid component of a composition that dissolves at least one solid component, or dilutes at least one liquid component, of the composition (in the case of water, adventitious amounts of water are not included by the term "solvent").

Methods according to the present disclosure are particularly useful for small gauge copper, which tends to break when subjected to knitting processes. It is especially difficult to knit copper filaments a) into a fabric configured to have a loop of copper filament disposed at an angle to a knit layer, b) into an interlock pattern, or c) into a spacer fabric. For instance, employing a two-bed knitting machine typically requires bending a yarn or filament at one or more angles likely to break a small gauge copper filament. Further, it can be a challenge to knit copper filaments into a fabric having a large number of loops per inch, e.g., 5 or more loops per inch. It has been discovered that it is possible to enable knitting of small gauge copper filaments by employing a load-carrying yarn to relieve some of the stresses caused by bending, looping, pulling, etc., during knitting processes.

Figure 10:
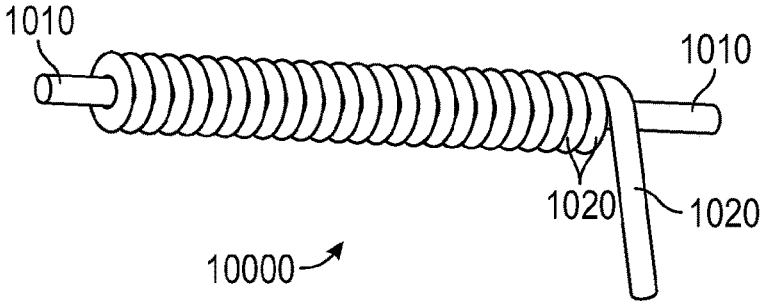
FIG. 10 is a schematic perspective view of a filament wrapped around a load-carrying yarn.

Although simply placing a load-carrying yarn directly adjacent to the copper filament, in contact along their longitudinal axes, was found to be insufficient to enable knitting of the copper filament, various methods of twisting and wrapping the load-carrying yarn and copper filament together allowed the copper filament to be successfully knitted. Typically, the copper filament and the load-carrying yarn are twisted or wrapped together to form 4 twists (or wraps) or greater per meter of material (i.e., yarn and/or filament), 6 twists or greater per meter, 10 twists or greater per meter, 20 twists or greater per meter, 30 twists or greater per meter, 50 twists or greater per meter, 70 twists or greater per meter, 100 twists or greater per meter, 150 twists or greater per meter, 200 twists or greater per meter, 250 twists or greater per meter, or 300 twists or greater per meter; and 750 twists (or wraps) or less per meter of material, 700 twists or less per meter, 650 twists or less per meter, 600 twists or less per meter, 550 twists or less per meter, 500 twists or less per meter, 450 twists or less per meter, 400 twists or less per meter, or 350 twists or less per meter. In some embodiments, a copper filament is wrapped around a load-carrying yarn. Referring to FIG. 10, a schematic perspective view is provided of a filament 1020 wrapped around a load-carrying yarn 1010, providing a wrapped yarn 10000. In some embodiments, a copper filament and a load-carrying yarn are twisted together in an S twist, while in other embodiments a copper filament and a load-carrying yarn are twisted together in a Z twist. Twisting and/or wrapping of filaments and yarns can be performed manually or by feeding the materials through a yarn twister.

Combinations of twisting and wrapping may also be useful. For instance, in an embodiment, a first copper filament is twisted around a second copper filament in a first direction, then the twisted first and second copper filaments are further twisted in a second, opposing, direction around a third (continuous) copper filament to form a filament bundle. The filament bundle may then be twisted with, or wrapped around, a load-carrying yarn. In another embodiment, a first copper filament is wrapped around a load-carrying yarn in the S direction or Z direction, thereby providing a combined load-carrying yarn and first copper filament. Then a second copper filament is wrapped around the combined load-carrying yarn and first copper filament, typically at the same number of twists per meter, and in the opposite direction that the first copper filament was wrapped around the load-carrying yarn.

Referring to FIG. 1, a generalized flow chart is provided of a method of making a knit fabric. In particular, the method includes the steps of A) twisting or wrapping at least one continuous copper filament with a load-carrying yarn, wherein the load-carrying yarn exhibits a minimum bend radius that wraps around an object having a diameter of 0.43 millimeters 110; B) b) setting at least one tension setting on a knitting machine 120; and C) using a knitting program that defines a plurality of stitch settings, knitting a fabric 130.

The methods, employing the load-carrying yarn, are capable of knitting copper fabrics having a variety of three-dimensional structures. For instance, referring to FIGS. 2A-2D, in some embodiments, the knit fabric 2000 comprises a layer of knit copper fabric 210 having a first major plane 220 wherein the fabric 210 has 5 to 18 loops per inch; and at least one loop 230 of copper filament extending out of the first major plane 220 such that the loop 230 of copper filament and the first major plane 220 of the knit copper fabric 200 form an angle (e.g., alpha) between 15 and 165 degrees. In some embodiments, such knit copper fabrics further comprise a second layer of knit copper fabric attached to the first layer of knit copper fabric. Advantageously, the first layer and the second layer may be attached by the at least one continuous copper filament, which is also enabled by the use of the load-carrying yarn during the knitting process.

As noted, knit copper fabrics can be formed having 5 to 18 loops per inch (2.54 centimeters) of the fabric. In some embodiments, the knit copper fabric has 5 loops or greater per inch, 6 loops or greater per inch, 7 loops or greater per inch, 8 loops or greater per inch, 9 loops or greater per inch, 10 loops or greater per inch, or 11 loops or greater per inch; and 18 loops or less per inch, 17 loops or less per inch, 16 loops or less per inch, 15 loops or less per inch, 14 loops or less per inch, 13 loops or less per inch, or 12 loops or less per inch. In select embodiments, the knit copper fabric contains 5 to 12 loops per inch of a fabric.

Figure 3:
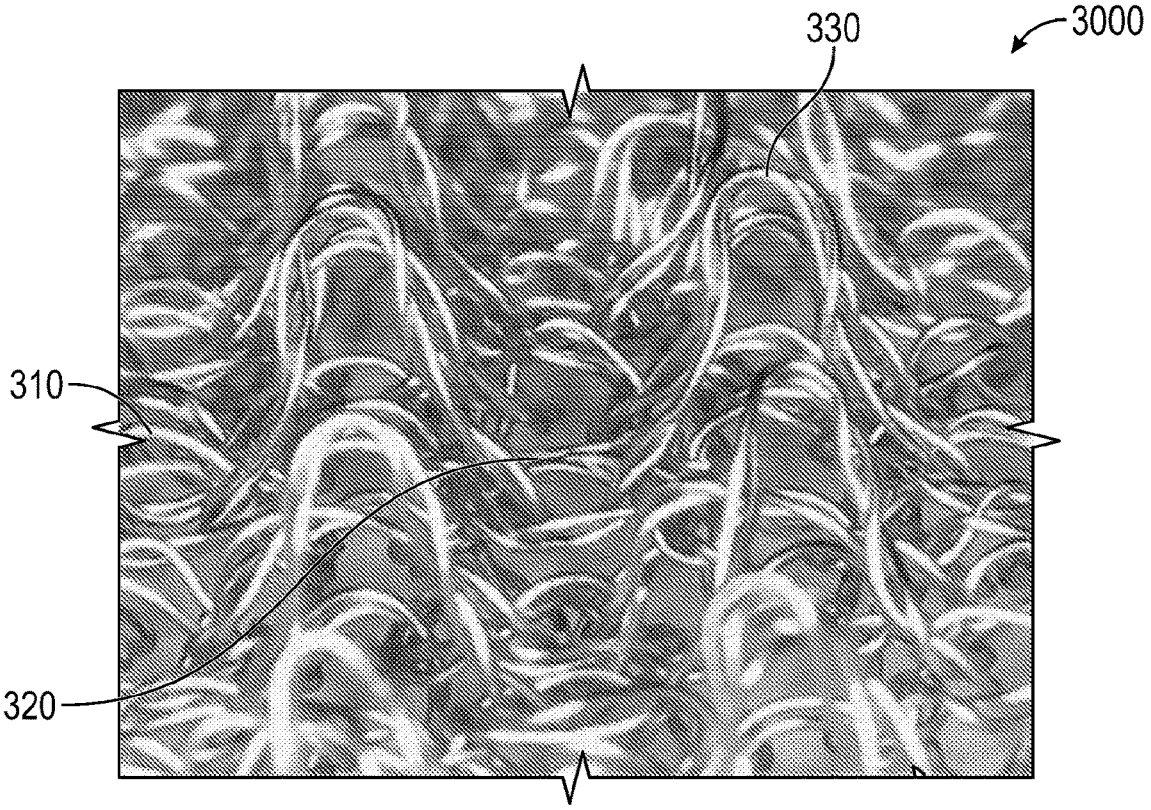
FIG. 3 is a photograph of an exemplary knit fabric, prepared according to Example 1.
Figure 5:
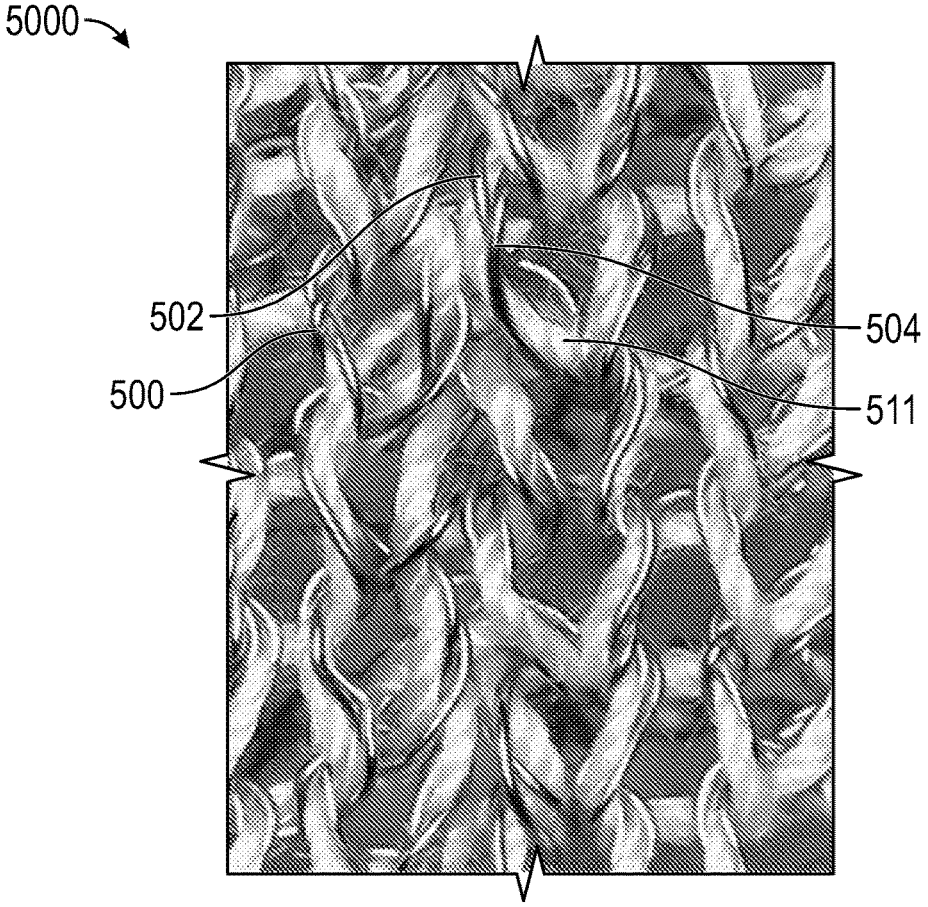
FIG. 5 is a photograph of an exemplary knit fabric including the load-carrying yarn, prepared according to Example 1.

FIG. 3 shows a photograph of an exemplary knit fabric 3000 made according to Example 1, after removal of the load-carrying yarn (see FIG. 5 for the knit fabric prior to removing the load-carrying yarn). The knit fabric 3000 comprises a layer of knit copper fabric 310 having a first major plane 320. The fabric 310 has 15 loops per inch. The knit fabric 3000 includes a plurality of loops 330 of copper filament extending out of the first major plane 320, and the loops 330 of copper filament and the first major plane 320 of the knit copper fabric 300 each form an angle that is independently between 15 and 165 degrees.

Figure 4A:
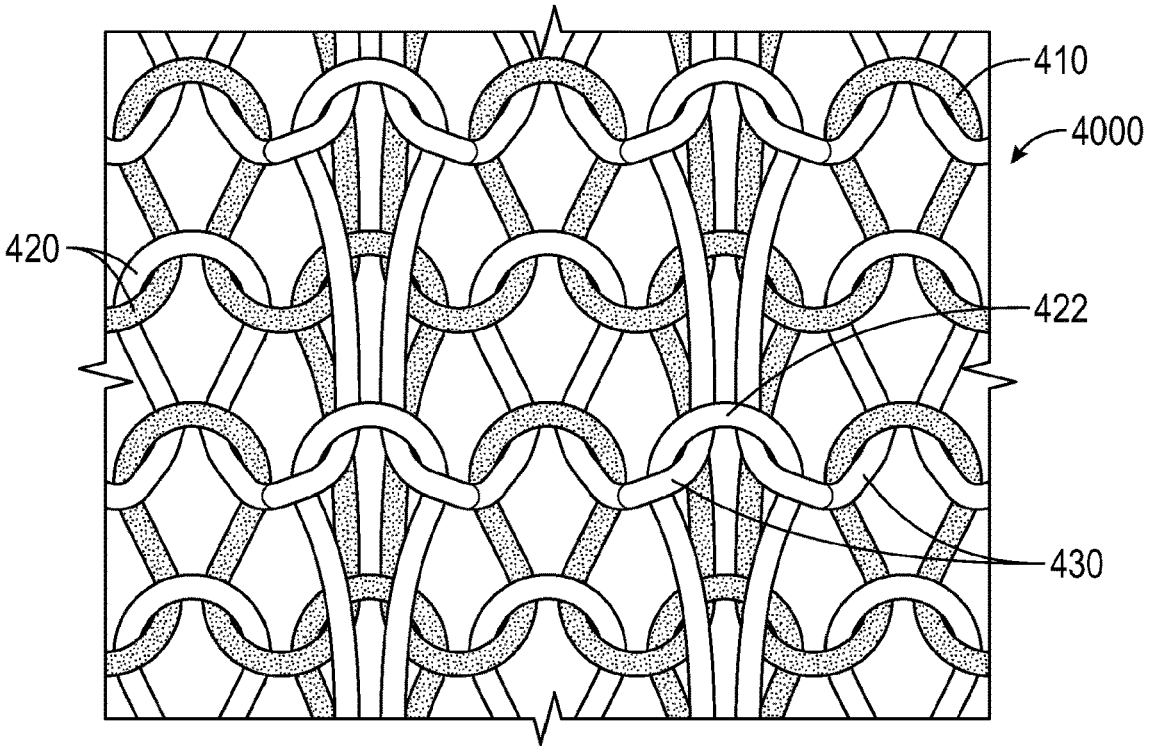
FIG. 4A is a schematic top view of another exemplary knit fabric, preparable according to the present disclosure.
Figure 4B:
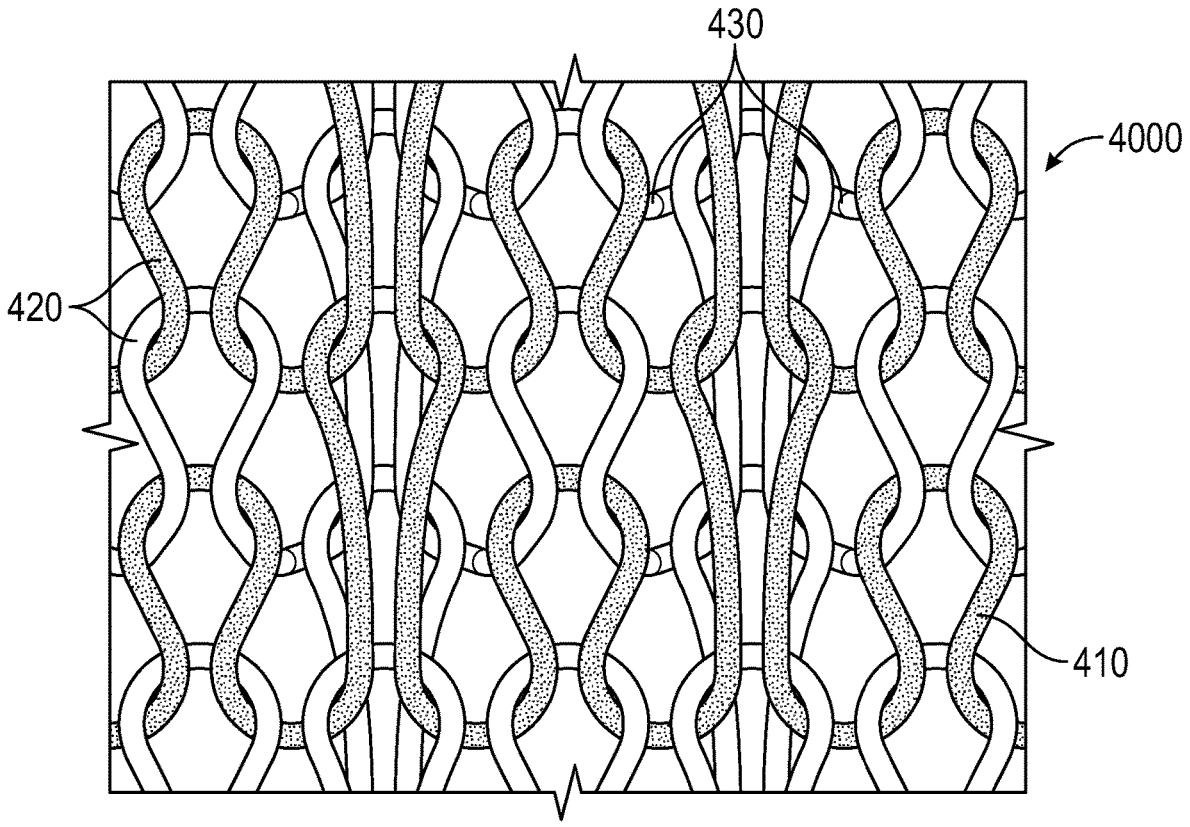
FIG. 4B is a schematic bottom view of the exemplary knit fabric of FIG. 4A.
Figure 4C:
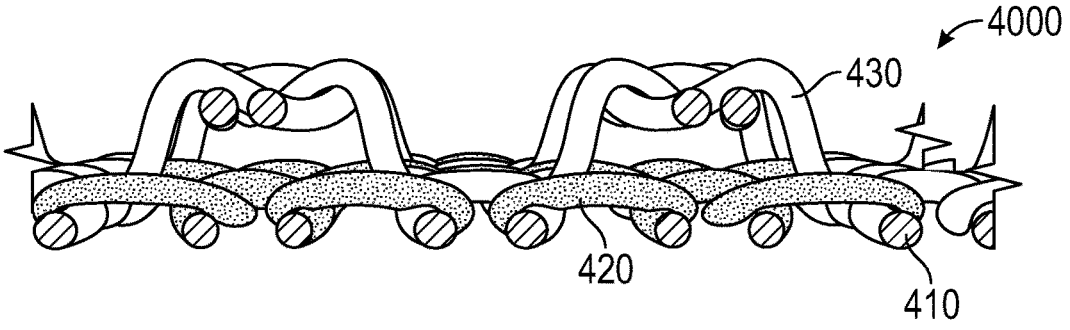
FIG. 4C is a schematic front view of the exemplary knit fabric of FIG. 4A.
Figure 12:
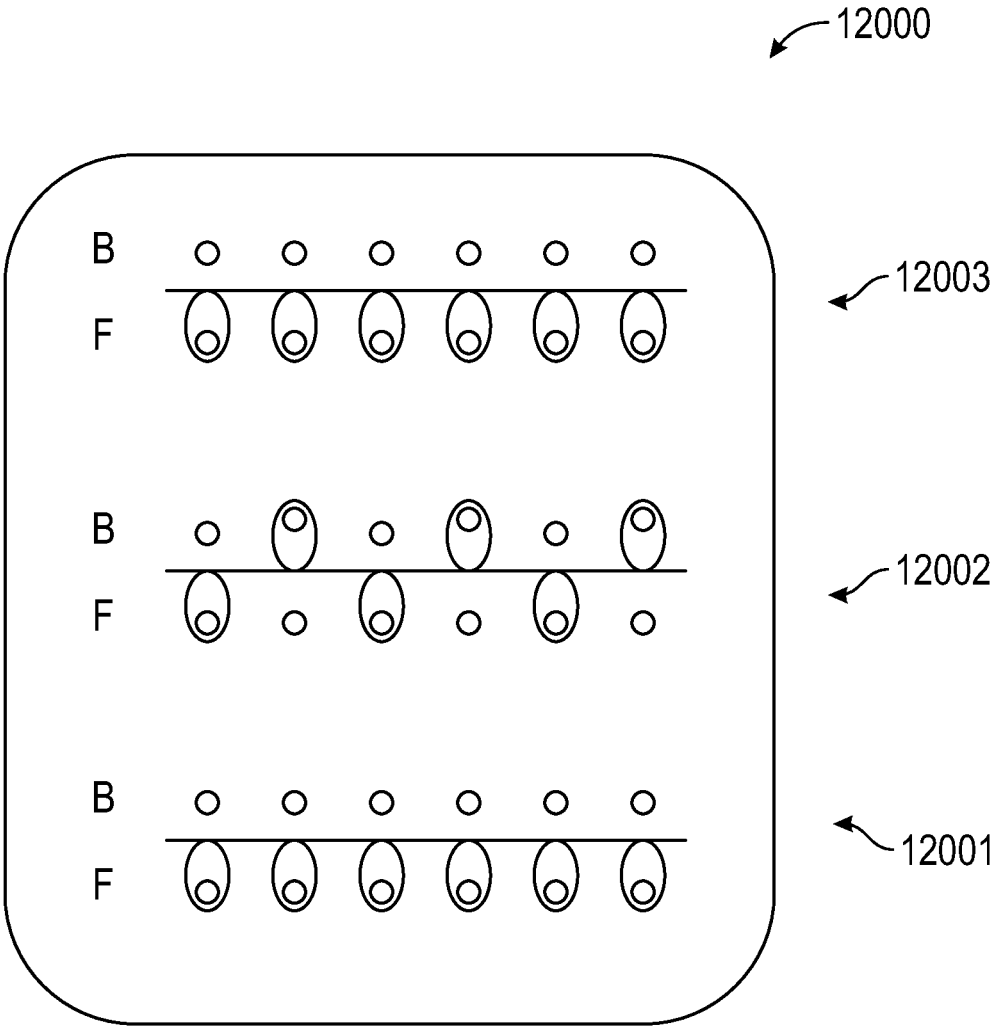
FIG. 12 is a knit pattern diagram of a rib knit pattern.

Referring to FIGS. 4A-4C, in some embodiments, the knit fabric 4000 comprises a layer of knit copper fabric 410 having a first major plane 420 and a plurality of loops 430 having the form of rib knits of copper filament extending out of the first major plane 420. This embodiment includes a series of two loops 430 of copper filament extending out of the first major plane 420 that are knitted together, e.g., by an in-plane loop 422. The loops 430 of copper filament and the first major plane 420 of the knit copper fabric 400 each form an angle independently between 15 and 165 degrees. Referring to FIG. 12, a knit pattern diagram 12000 is provided for a rib knit pattern on a two-bed machine having a front bed (FB) and a back bed (BB). The knit pattern includes a first pass 12001, a second pass 12002, and a third pass 12003.

Referring to FIG. 5, a photograph of a knit fabric 5000 is shown, prepared according to Example 1 below. The knit fabric 5000 includes a knit layer 500 comprising a first continuous copper filament 502 twisted around a second continuous copper filament 504. Each of the first and second copper filaments 502, 504, are twisted around a load-carrying yarn 511 in opposing twist directions (i.e., one of the filaments is twisted around the load-carrying yarn in a S twist and the other around the load-carrying yarn in a Z twist).

Figure 6A:
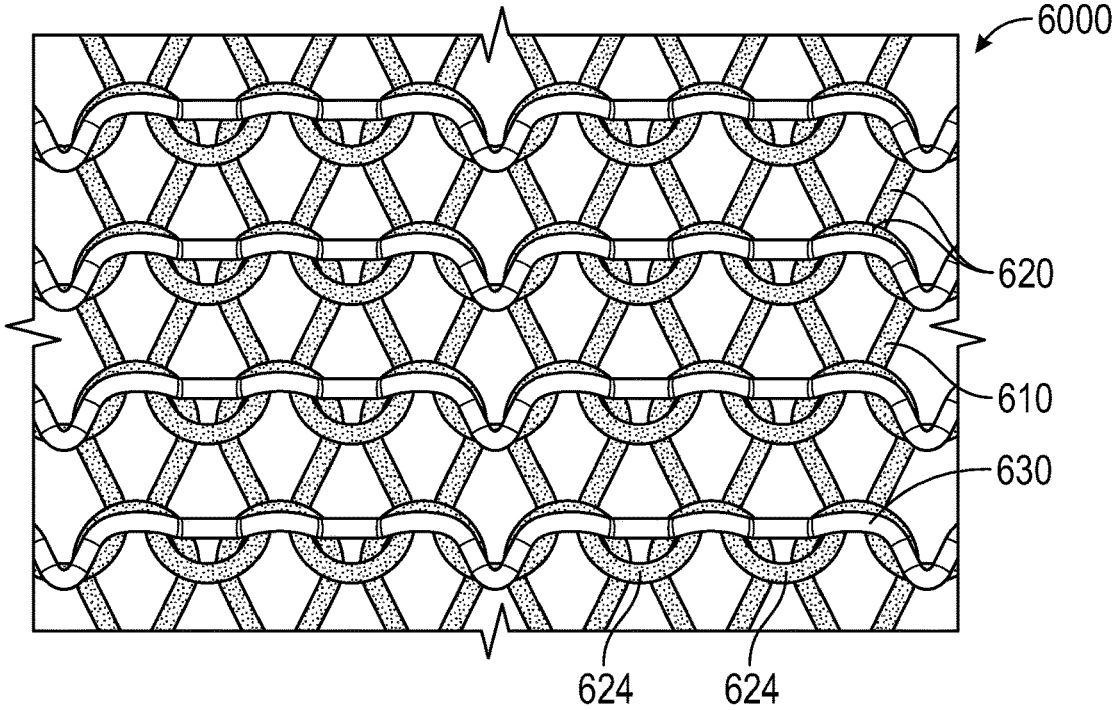
FIG. 6A is a schematic top view of a further exemplary knit fabric, preparable according to the present disclosure.
Figure 6B:
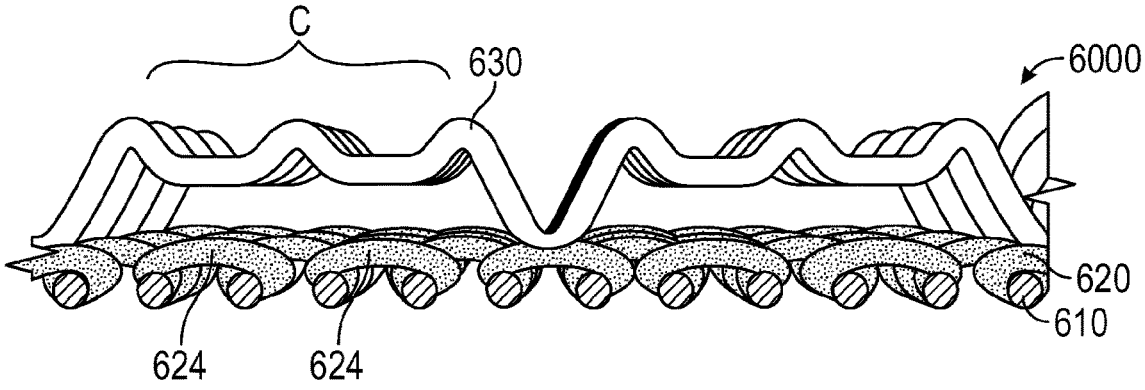
FIG. 6B is a schematic front view of the exemplary knit fabric of FIG. 6A.
Figure 6C:
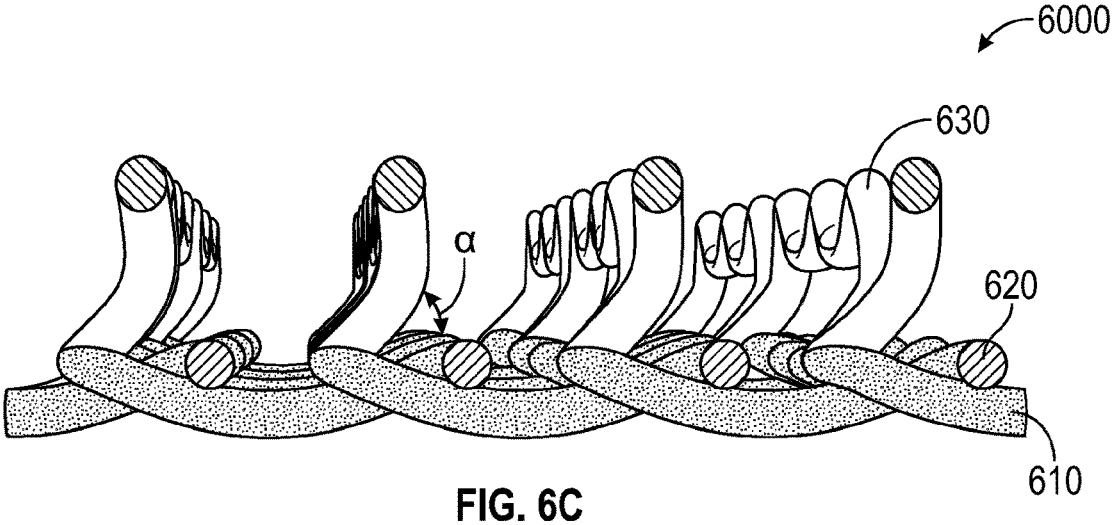
FIG. 6C is a schematic side view of the exemplary knit fabric of FIG. 6A.

Referring to FIGS. 6A-6C, in some embodiments, a knit fabric 6000 comprises a layer of knit copper fabric 610 having a first major plane 620 and a plurality of loops 630 extending out of the first major plane 620. The knit copper fabric 610 comprises at least one loop 630 of copper filament extending out of the first major plane 620 that extends across a plurality of loops 624 of the layer of knit copper fabric 610. In this embodiment, the loops 630 of copper filament span two loops 624. Further, in the embodiment depicted in FIGS. 6A-6C, a plurality of loops 630 of copper filament extending out of the first major plane 620 each has a crimped shape C along a length of each loop 630. A crimped shape provides a greater surface area along a length than a straight piece. The loop 630 of copper filament and the first major plane 620 of the knit copper fabric 610 form an angle (e.g., alpha) between 15 and 165 degrees.

Figure 7A:
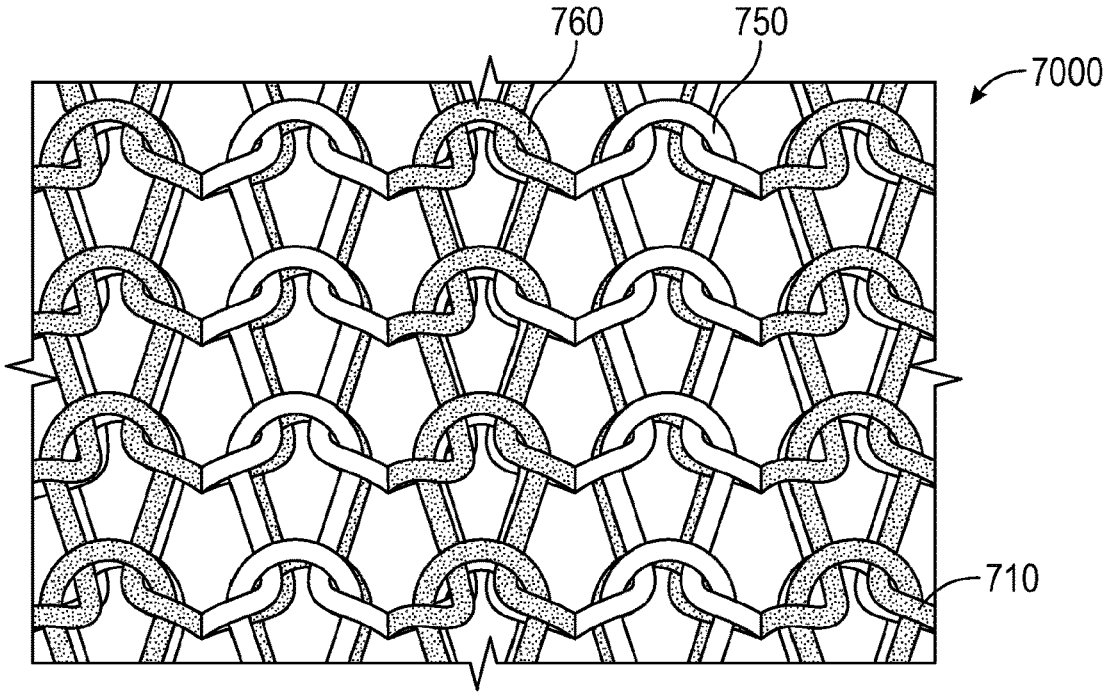
FIG. 7A is a schematic top view of an additional exemplary knit fabric, preparable according to the present disclosure.
Figure 7B:
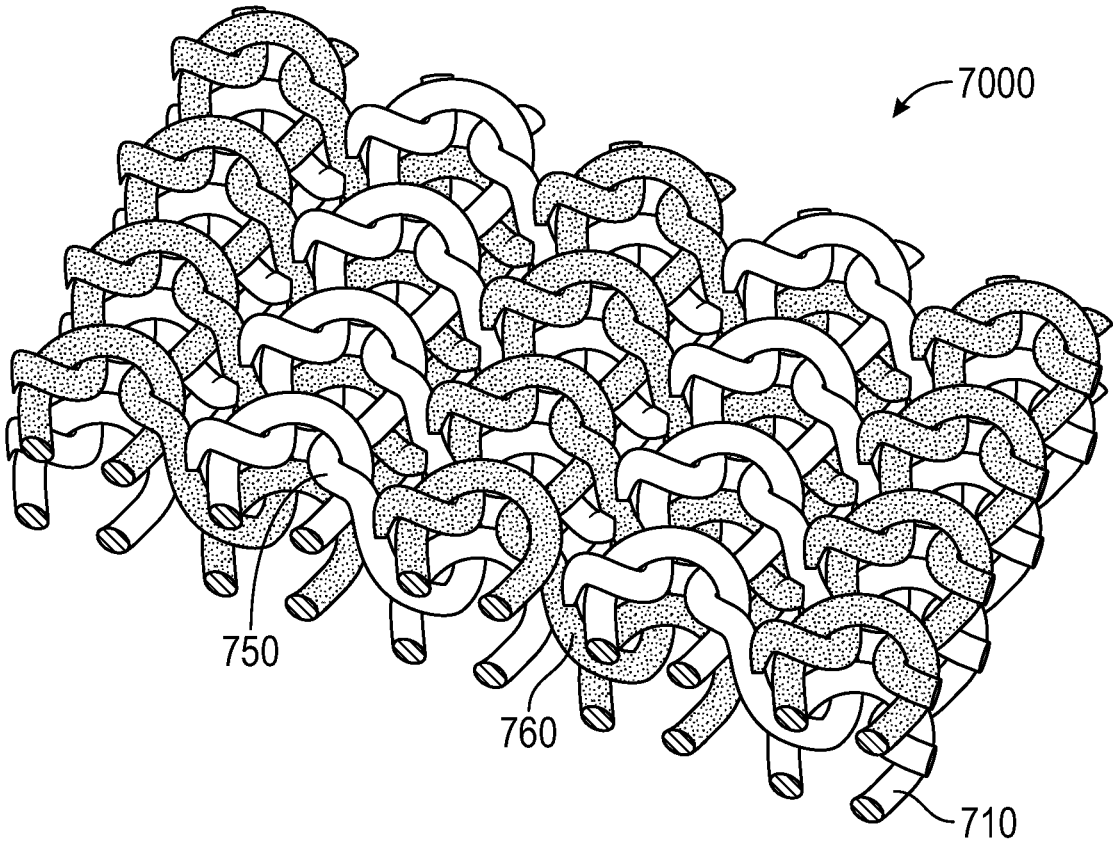
FIG. 7B is a schematic perspective view of the exemplary knit fabric of FIG. 7A.
Figure 7C:
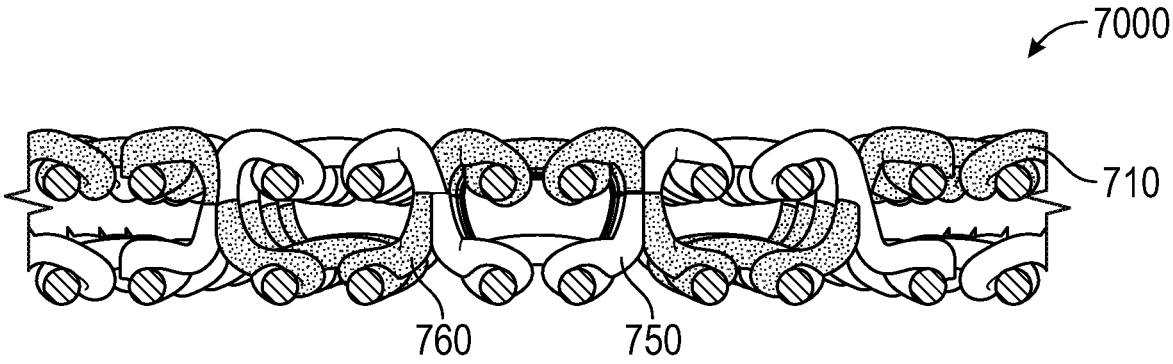
FIG. 7C is a schematic front view of the exemplary knit fabric of FIG. 7A.
Figure 8A:
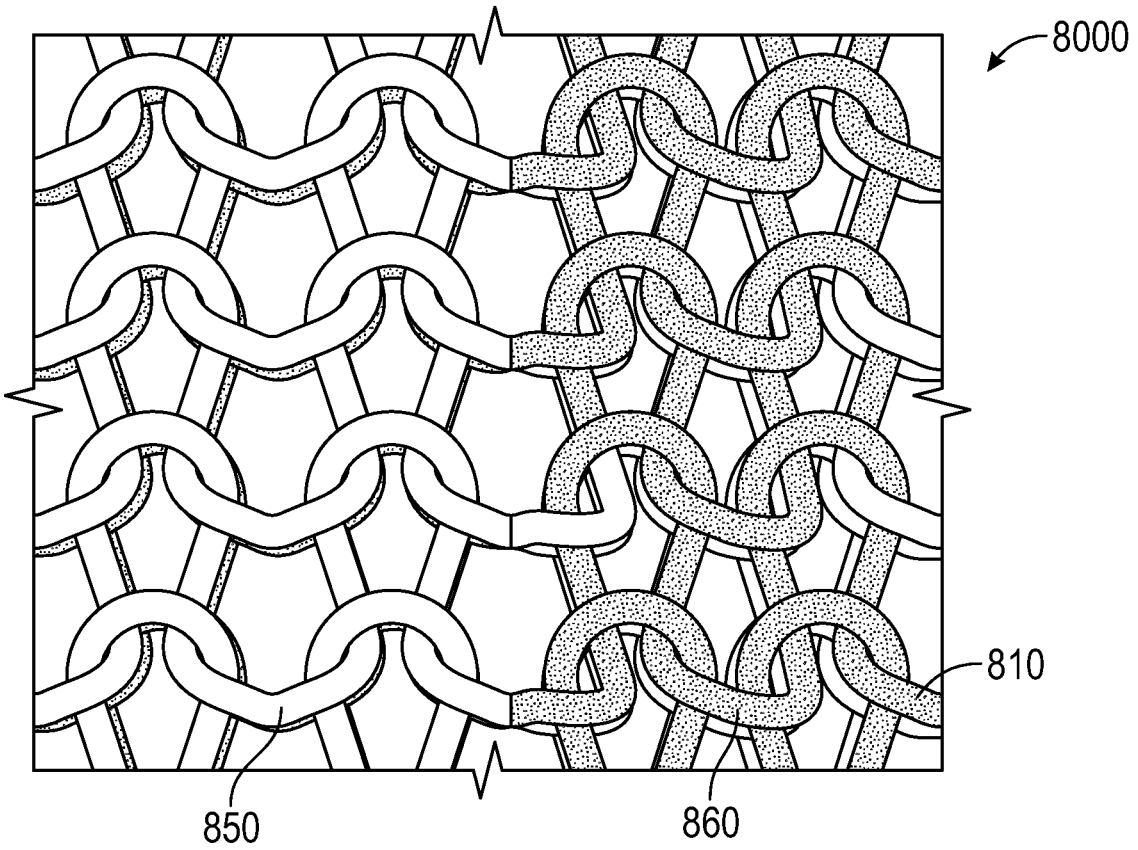
FIG. 8A is a schematic top view of yet another exemplary knit fabric, preparable according to the present disclosure.
Figure 8B:
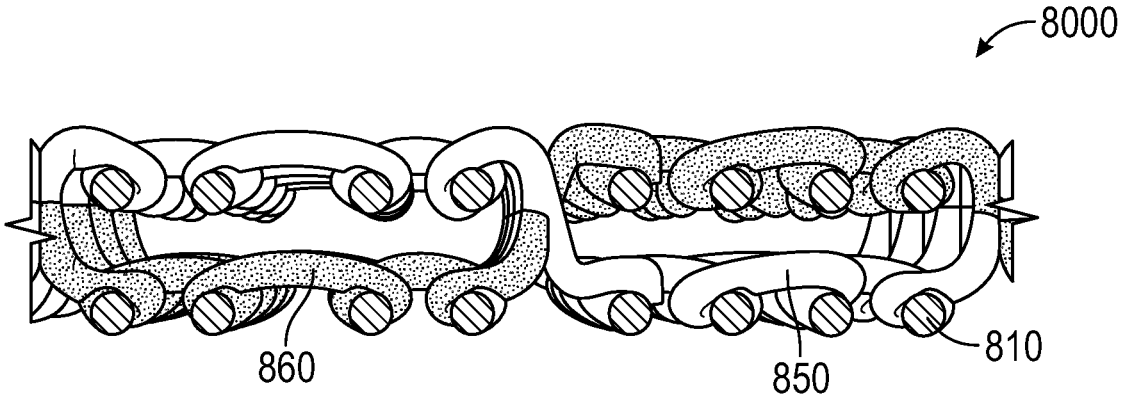
FIG. 8B is a schematic front view of the exemplary knit fabric of FIG. 8A.
Figure 13:
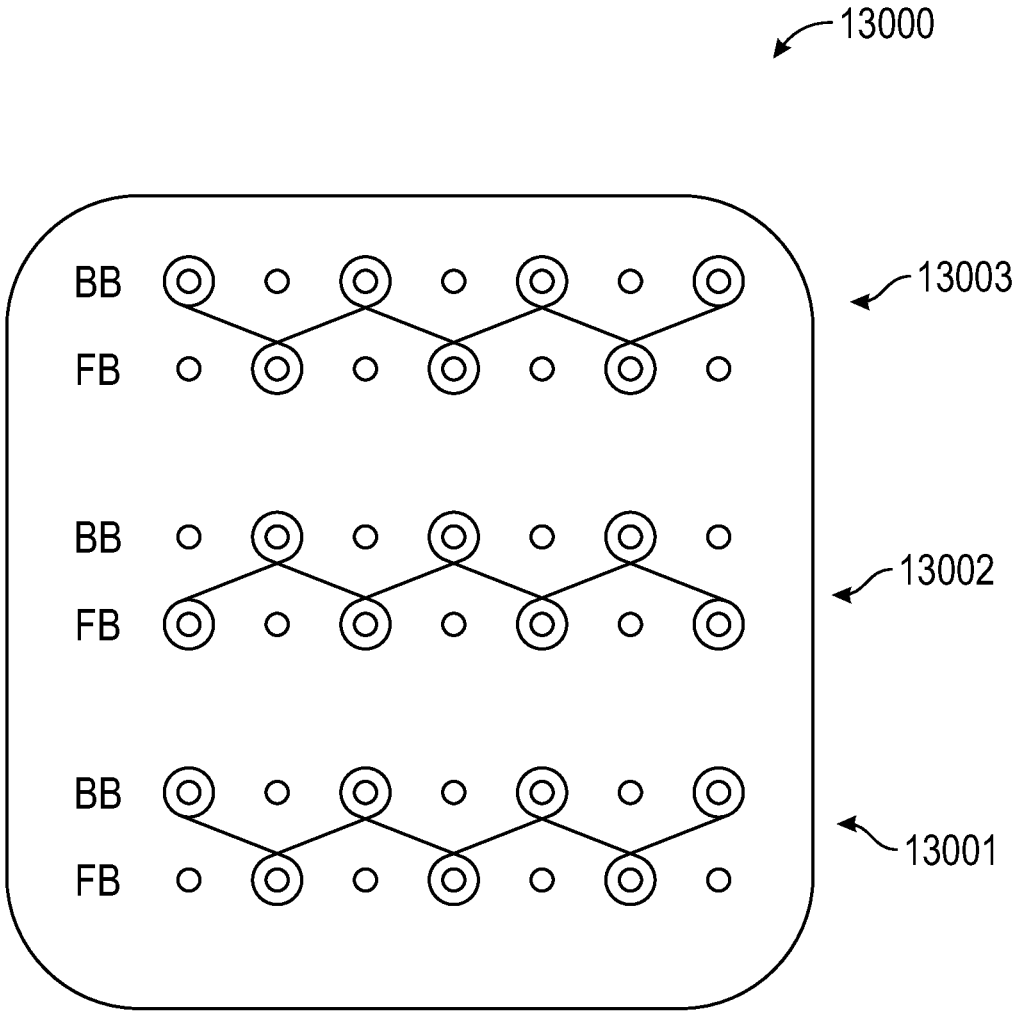
FIG. 13 is a knit pattern diagram of an interlock knit pattern.

Referring to FIGS. 7A-7C, in some embodiments, a knit fabric 7000 comprises an interlock pattern comprising at least two continuous copper filament paths 750 and 760 per layer 710 of the knit fabric 7000. Such an interlock knit pattern can be formed according to methods of the present disclosure by knitting first and second fabric layers on opposite beds of a knitting machine and knitting a connecting layer of rib knitted loops between the two layers. Referring to FIG. 13, a knit pattern diagram 13000 is provided for an interlock knit pattern on a two-bed machine having a front bed (FB) and a back bed (BB). The knit pattern includes a first pass 13001, a second pass 13002, and a third pass 13003. The interlock pattern shown in FIGS. 7A-7C is a 1×1 stitch knit. Similarly, FIGS. 8A-8B provide schematic views of a knit fabric 8000 comprising an interlock pattern comprising at least two continuous copper filament paths 850 and 860 per layer 810 of the knit fabric 8000. The interlock pattern shown in FIGS. 8A-8B is a 2×2 stitch knit. Any number of stitches may be used as desired. Higher numbers of stitch knits may form a series of tubes, for instance tubes that are large enough in which to set individual batteries. Further, an interlock pattern may have one or more loops extending out of a major plane of the interlock pattern of the knit fabric, e.g., similar to the loops shown in FIGS. 2C, 3, and 6B.

Figure 9A:
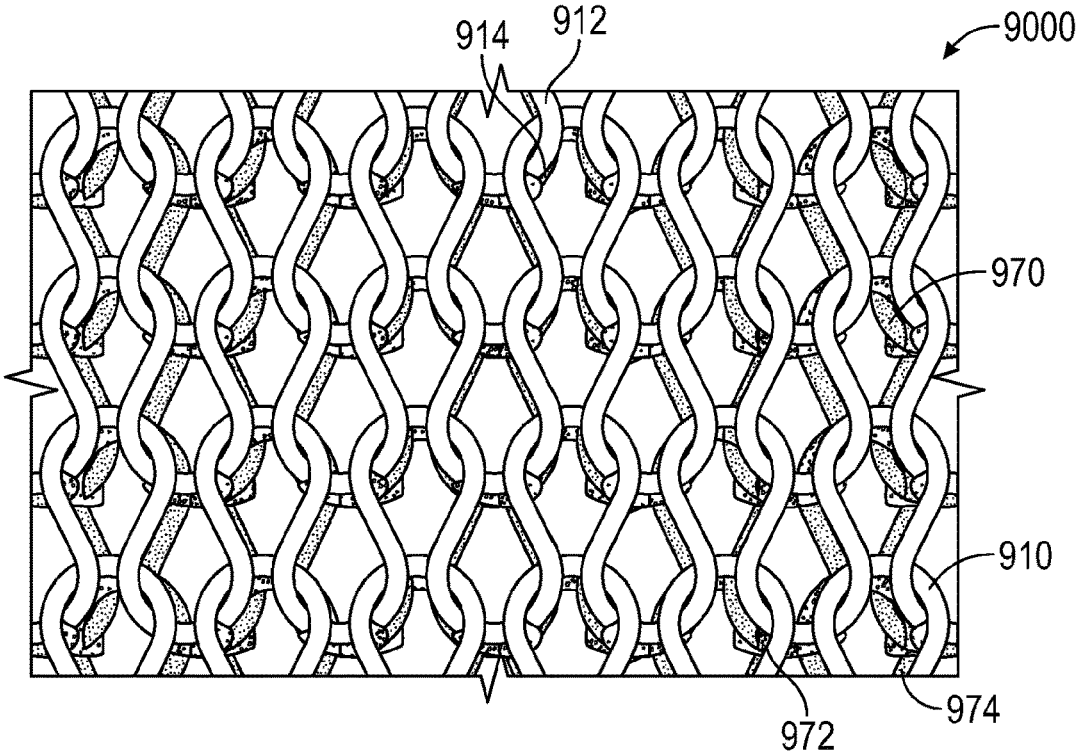
FIG. 9A is a schematic top view of a still further exemplary knit fabric, preparable according to the present disclosure.
Figure 9B:
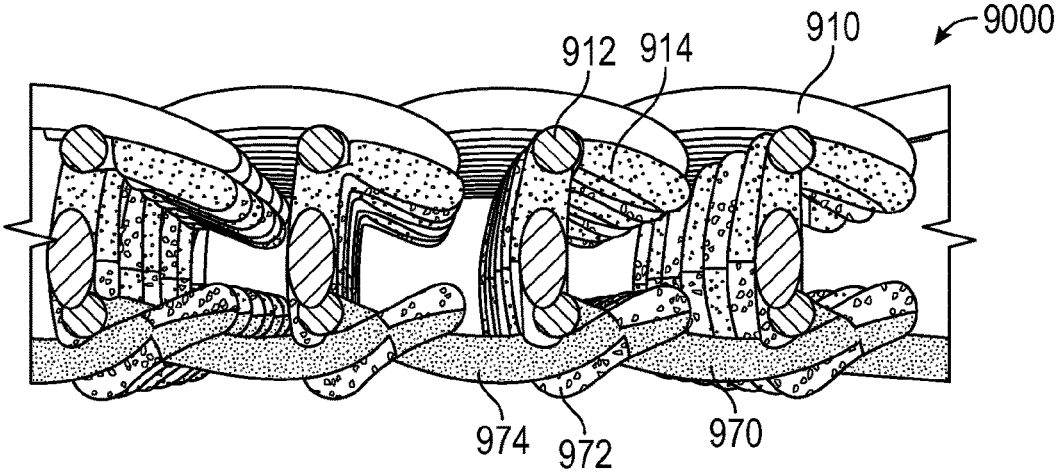
FIG. 9B is a schematic side view of the exemplary knit fabric of FIG. 9A.

Referring to FIGS. 9A-9B, in some embodiments, a knit fabric 9000 comprises a spacer fabric comprising a first layer 910 of knit copper fabric interconnected with a second layer 970 of knit copper fabric. In this embodiment, the spacer fabric 910 comprises two knitted layers 910 and 970 that are connected by a tucked layer. Optionally, the first layer 910 of knit copper fabric comprises at least two continuous copper filament paths 912 and 914. Similarly, the second layer 970 of knit copper fabric optionally comprises at least two continuous copper filament paths 972 and 974.

Figure 11:
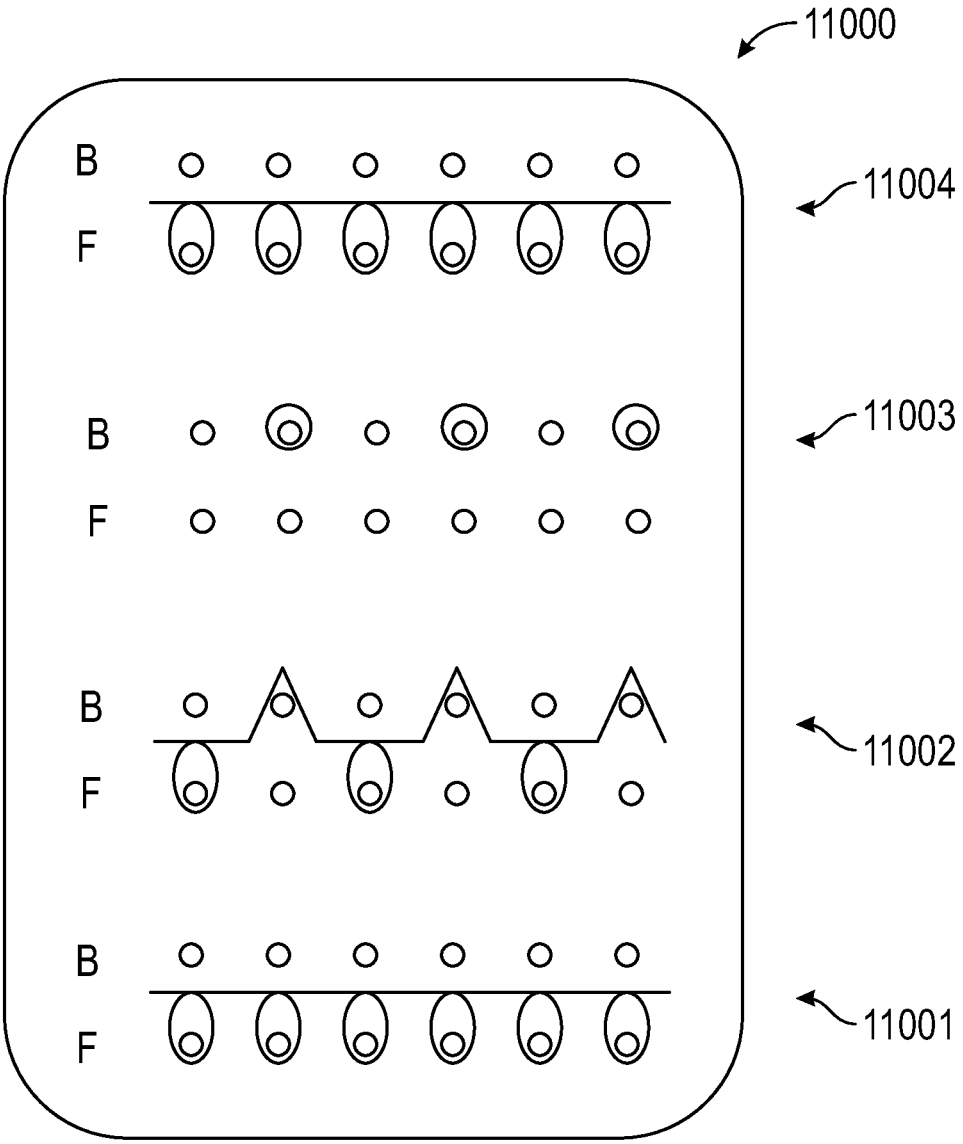
FIG. 11 is a knit pattern diagram of a tuck knit pattern.

Referring to FIG. 11, a knit pattern diagram 11000 is provided for a tuck knit pattern on a two-bed machine having a front bed (FB) and a back bed (BB). The knit pattern includes a first pass 11001, a second pass 11002, a third pass 11003, and a fourth pass 11004.

Typically, the copper filament according to the present disclosure has a diameter of 0.063 millimeters (mm) (42 gauge) or greater, 0.071 mm (41 gauge) or greater, 0.079 mm (40 gauge) or greater, 0.089 mm (39 gauge) or greater, 0.102 mm (38 gauge) or greater, 0.114 mm (37 gauge) or greater, 0.127 mm (36 gauge) or greater, 0.142 mm (35 gauge) or greater, 0.160 mm (34 gauge) or greater, 0.180 mm (33 gauge); and a diameter of 0.320 mm (28 gauge) or less, 0.287 mm (29 gauge) or less, 0.254 mm (30 gauge) or less, 0.226 mm (31 gauge) or less, or 0.203 mm (32 gauge) or less. Stated another way, the copper filament has a diameter of 0.063 millimeters (42 gauge) to 0.320 millimeters (28 gauge), inclusive. In some embodiments, the copper filament has a diameter of 0.127 millimeters (36 gauge).

Optionally, the copper filament is a coated copper filament, such as coated with polyurethane.

The load-carrying yarn is not particularly limited as long the yarn has a minimum bend radius that wraps around an object having a diameter of 0.43 millimeters. In some embodiments, the load-carrying yarn comprises nylon, polyester, polyvinyl alcohol (PVA), cotton, bamboo, wool, aramid, spandex, stainless steel, or any combination thereof. It has been discovered that bamboo is the most knittable load-carrying yarn of these listed, thus if a copper filament cannot be knit with bamboo in a certain pattern without breaking, it is expected that none of the other load-carrying yarns would be successful either in knitting that pattern with the copper filament. In select embodiments, PVA is a preferred load-carrying yarn material due to its water solubility for ease of removal after knitting of the copper filament is complete.

Referring again to FIG. 1, the method optionally further includes the step of removing the load-carrying yarn 140 from the knit fabric. The presence of a load-carrying yarn in the knit fabric may be undesirable for certain applications of use for the knit fabric, e.g., thermal management applications in which the knit fabric will be subjected to temperatures above a melting point and/or decomposition point for the material of the load-carrying yarn. Suitable methods of removing the load-carrying yarn will depend on the composition of the yarn. For instance, when the yarn is water-soluble, it may be removed by washing with water. Typically, the load-carrying yarn can be removed using at least one of heat, flame, or solvent (e.g., organic solvent and/or water). If the process of removing the yarn results in any residue or byproduct remaining on the knit fabric, the method may further comprise the step of cleaning the knit copper fabric 150. For example, combustion over a flame may deposit a tarnish on at least some of the surfaces of the copper fabric as the load-carrying yarn is burned off, which in some embodiments may be removed with a cleaning solution (e.g., containing sodium chloride and acetic acid).

Advantageously, knit copper fabrics according to at least certain embodiments are useful as thermal interface materials to transfer heat between other materials. For instance, a knit copper fabric may exhibit a thermal conductivity in a z-axis (e.g., through one major surface of the knit copper fabric through the opposing major surface of the knit copper fabric) of 0.2 W/m*K or greater, 0.3 W/m*K or greater, 0.4 W/m*K or greater, 0.5 W/m*K or greater, 1.0 W/m*K or greater, 1.5 W/m*K or greater, 2.0 W/m*K or greater, 2.5 W/m*K or greater, 3.0 W/m*K or greater, 3.5 W/m*K or greater, 4.0 W/m*K or greater, 5.0 W/m*K or greater, 6.0 W/m*K or greater, 7.0 W/m*K or greater, 8.0 W/m*K or greater, 9.0 W/m*K or greater, or 10 W/m*K or greater; and 20 W/m*K or less.

The thermal conductivity of knit copper fabrics can be measured according to ASTM D5470 ("Standard Test Method for Thermal Transmission Properties of Thermally Conductive Electrical Insulation Materials") using, for instance, a Thermal Interface Material Tester Model TIM1400 (e.g., obtained from Analysis Tech Corp., Wakefield, MA). Discs with a diameter of 33 mm (1.3 inches) are extracted from the knitted webs using a die punch. The sample temperature on the TIM tester is set to 50° C. (122° F.), and test pressure is applied to target 5% compression of the sample (compression-ratio control mode). A thin layer of silicone oil (e.g., DC 200-1000 CS, obtained from Analysis Tech Corp., Wakefield, MA) is applied to the instrument's surfaces before placing the sample into the TIM tester to reduce the contact resistance between test surfaces and sample surfaces (e.g., providing increased surface wet-out). To subtract the contact resistance sample discs are stacked to different thicknesses and a plot of impedance in units of Kelvin meter squared per watt ($K\text{-}m^2/W$) vs. thickness (m) is created. The inverse of a linear fitted slope to this plot is the measured material thermal conductivity in units of watts per meter Kelvin (W/mK).

Various embodiments are provided that include knit fabrics and methods of making knit fabrics.

In a first embodiment, the present disclosure provides a knit fabric. The knit fabric comprises at least one continuous copper filament formed into a knit fabric. The knit fabric comprises a layer of knit copper fabric having a first major plane, wherein the fabric has 5 to 18 loops per inch; and at least one loop of copper filament extending out of the first major plane such that the loop of copper filament and the first major plane of the knit copper fabric form an angle between 15 and 165 degrees.

In a second embodiment, the present disclosure provides a knit fabric according to the first embodiment, wherein the copper filament has a diameter of 0.063 millimeters (42 gauge) to 0.32 millimeters (28 gauge), inclusive.

In a third embodiment, the present disclosure provides a knit fabric according to the first embodiment or the second embodiment, wherein the copper filament is twisted.

In a fourth embodiment, the present disclosure provides a knit fabric according to the third embodiment, wherein the copper filament is twisted around a yarn.

In a fifth embodiment, the present disclosure provides a knit fabric according to the fourth embodiment, wherein the yarn exhibits a minimum bend radius that wraps around an object having a diameter of 0.43 millimeters.

In a sixth embodiment, the present disclosure provides a knit fabric according to the fourth embodiment or the fifth embodiment, wherein the yarn comprises nylon, polyester, polyvinyl alcohol (PVA), cotton, bamboo, wool, aramid, spandex, or a combination thereof.

In a seventh embodiment, the present disclosure provides a knit fabric according to any of the first through sixth embodiments, wherein the copper filament is twisted around a second continuous copper filament.

In an eighth embodiment, the present disclosure provides a knit fabric according to the seventh embodiment, wherein the copper filament is twisted around the second continuous copper filament in a first direction and the twisted copper filaments are further twisted in a second, opposing, direction around at least a third continuous copper filament to form a filament bundle.

In a ninth embodiment, the present disclosure provides a knit fabric according to any of the first through eighth embodiments, further comprising a second layer of knit copper fabric attached to the first layer of knit copper fabric.

In a tenth embodiment, the present disclosure provides a knit fabric according to the ninth embodiment, wherein the first layer and the second layer are attached by the at least one continuous copper filament.

In an eleventh embodiment, the present disclosure provides a knit fabric according to any of the first through tenth embodiments, wherein the layer of knit copper fabric has 5 to 12 loops per inch.

In a twelfth embodiment, the present disclosure provides a knit fabric according to any of the first through eleventh embodiments, wherein the copper filament is a coated copper filament.

In a thirteenth embodiment, the present disclosure provides a knit fabric according to any of the first through twelfth embodiments, exhibiting a thermal conductivity of 0.5 W/m*K or greater.

In a fourteenth embodiment, the present disclosure provides a knit fabric according to any of the first through thirteenth embodiments, wherein the at least one loop of copper filament extending out of the first major plane comprises a plurality of loops.

In a fifteenth embodiment, the present disclosure provides a knit fabric according to any of the first through thirteenth embodiments, wherein the at least one loop of copper filament extending out of the first major plane extends across a plurality of loops of the layer of knit copper fabric.

In a sixteenth embodiment, the present disclosure provides a knit fabric according to any of the first through fifteenth embodiments, wherein the at least one loop of copper filament extending out of the first major plane comprises a crimped shape along a length of the at least one loop.

In a seventeenth embodiment, the present disclosure provides a knit fabric according to any of the first through sixteenth embodiments, comprising at least two loops of copper filament extending out of the first major plane that are knitted together.

In an eighteenth embodiment, the present disclosure provides a knit fabric. The knit fabric comprises an interlock pattern comprising at least two continuous copper filament paths per layer.

In a nineteenth embodiment, the present disclosure provides a knit fabric according to the eighteenth embodiment, wherein the interlock pattern is a 1×1 knit.

In a twentieth embodiment, the present disclosure provides a knit fabric according to the eighteenth embodiment, wherein the interlock pattern is a 2×2 knit.

In a twenty-first embodiment, the present disclosure provides a knit fabric. The knit fabric comprises a spacer fabric knit comprising a first layer of knit copper fabric interconnected with a second layer of knit copper fabric.

In a twenty-second embodiment, the present disclosure provides a knit fabric according to the twenty-first embodiment, wherein the first layer of knit copper fabric comprises at least two continuous copper filament paths.

In a twenty-third embodiment, the present disclosure provides a knit fabric according to any of the twenty-first embodiment or the twenty-second embodiment, wherein the second layer of knit copper fabric comprises at least two continuous copper filament paths.

In a twenty-fourth embodiment, the present disclosure provides a method of making a knit fabric. The method comprises a) twisting or wrapping at least one continuous copper filament with a load-carrying yarn; b) setting at least one tension setting on a knitting machine; and c) using a knitting program that defines a plurality of stitch settings, knitting a fabric. The load-carrying yarn exhibits a minimum bend radius that wraps around an object having a diameter of 0.43 millimeters. The fabric comprises i) a layer of knit copper fabric having a first major plane wherein the fabric has 5 to 18 loops per inch; and ii) at least one loop of copper filament extending out of the first major plane such that the loop of copper filament and the first major plane of the knit copper fabric form an angle between 15 and 165 degrees.

In a twenty-fifth embodiment, the present disclosure provides a method of making a knit fabric. The method comprises a) twisting or wrapping at least one continuous copper filament with a load-carrying yarn; b) setting at least one tension setting on a knitting machine; and c) using a knitting program that defines a plurality of stitch settings, knitting a fabric. The load-carrying yarn exhibits a minimum bend radius that wraps around an object having a diameter of 0.43 millimeters. The fabric comprises i) an interlock knit pattern consisting of two layers knitted on opposite beds with a connecting layer of rib knitted loops between them, or ii) a spacer fabric that comprises two knitted layers connected by a tucked layer.

In a twenty-sixth embodiment, the present disclosure provides a method according to the twenty-fourth embodiment or twenty-fifth embodiment, further comprising removing the load-carrying yarn.

In a twenty-seventh embodiment, the present disclosure provides a method according to the twenty-sixth embodiment, wherein the load-carrying yarn is removed using at least one of heat, flame, or solvent.

In a twenty-eighth embodiment, the present disclosure provides a method according to the twenty-seventh embodiment, wherein the solvent is water.

In a twenty-ninth embodiment, the present disclosure provides a method according to any of the twenty-fourth through twenty-eighth embodiments, further comprising cleaning the knit copper fabric after removing the load-carrying yarn.

In a thirtieth embodiment, the present disclosure provides a method according to the twenty-ninth embodiment, wherein the knit copper fabric is cleaned using a solution comprising sodium chloride and acetic acid.

In a thirty-first embodiment, the present disclosure provides a method according to any of the twenty-fourth through thirtieth embodiments, wherein the load-carrying yarn comprises at least one of cotton, polyvinyl alcohol (PVA), bamboo, polyester, or nylon yarn.

In a thirty-second embodiment, the present disclosure provides a method according to any of the twenty-fourth through thirty-first embodiments, wherein the copper filament is twisted with the load-carrying yarn in an S twist.

In a thirty-third embodiment, the present disclosure provides a method according to any of the twenty-fourth through thirty-first embodiments, wherein the copper filament is twisted with the load-carrying yarn in a Z twist.

In thirty-fourth embodiment, the present disclosure provides a method according to any of the twenty-fourth through thirty-first embodiments, wherein the copper filament and the load-carrying yarn are fed through a yarn twister to wrap the copper filament around the load-carrying yarn in the S direction or Z direction at between 4 twists per meter and 750 twists per meter, thereby providing a combined load-carrying yarn and copper filament.

In a thirty-fifth embodiment, the present disclosure provides a method according to the thirty-fourth embodiment, further comprising feeding the combined load-carrying yarn and copper filament through a yarn twister and wrapping a second copper filament around the combined load-carrying yarn and copper filament at the same number of twists per meter and in the opposite direction that the copper filament was wrapped around the load-carrying yarn.

In thirty-sixth embodiment, the present disclosure provides a method according to any of the twenty-fourth through thirty-fifth embodiments, wherein the knit fabric is according to any of the first through twenty-third embodiments.

EXAMPLES

Unless otherwise noted or apparent from the context, all parts, percentages, ratios, etc. in the Examples and the rest of the specification are by weight.

TABLE 1

| Materials List | |
|---|---|
| Abbreviation | Description and Source |
| PVA yarn | Polyvinyl alcohol blended thread obtained under the trade designation "VANISH EXTRA Water Soluble Thread" from Superior Threads, (St. George, UT) |
| Copper filament | 36 American wire gauge (AWG) Enameled copper wire obtained from Remington Industries (Johnsburg, IL) |
| Bamboo yarn | Bamboo yarn obtained under the trade designation "BAMBU 12" from Silk City Fibers (Carlstadt, NJ) |
| Nylon yarn | Bonded Nylon, Tex 45, obtained from Superior Threads (St. George, UT) |
| Cotton yarn | |
| Polyester | Bonded Polyester Sewing Thread, Tex 30, obtained from obtained from Superior Threads (St. George, UT) |

Yarn Manufacturing Procedure

Yarns were prepared in the following way: A load-carrying yarn consisting of either cotton, PVA, bamboo, polyester, or nylon yarn, or a combination thereof, was fed through a yarn twister (obtained under the trade name AGTEKS DIRECTWIST D6"-C6", Istanbul Turkey) according to the manufacturer feeding diagram with a single copper filament fed to wrap around the load-carrying yarn. The copper was then wrapped around the load-carrying yarn in the S direction or the Z direction at 750 twists/meter. Once complete, the spool of combined load-carrying yarn and wrapped copper strand was removed, and the machine was next rethread with the combined yarn of copper wrapped load-carrying yarn used as a core yarn. The machine was then run by wrapping a single copper filament in the opposite direction around the combined yarn, at the same twist/meter. This combined yarn was then used to knit test swatches as described in the Knitting Procedure.

Knitting Procedure

The spun yarn was knitted on a hand driven knitting machine (obtained under the trade name TAIEXMIA TH860) with 8-gauge needles and ribbing attachment. A plain knit at least 15 needles wide and a 1×1 rib knit at least 15 needles wide were each knitted to validate the knittability. Breakage was assessed by visual inspection by the operator and if none was present the yarn was considered to pass. Once passing the hand knitting test, the same yarn was used on a 4 bed, 15-gauge motorized knitting machine (obtained under the trade name SHIMA SEIKI WHOLEGUARMENT MACH 2XS 153). The yarn was fed following the manufacturing diagram and the same pattern was used as on the hand machine to make both plain knit and 1×1 Rib swatches. The operator inspected the swatches and evaluated for broken copper filament before issuing a final pass/fail assessment.

Example 1

The yarn of Example 1 was prepared as in the Yarn Manufacturing Procedure, in which the load-carrying yarn was PVA yarn, except the load-carrying yarn was fed alongside the copper filament for twisting following the manufactures feeding diagram. This resulted in a twisted instead of wrapped yarn. The PVA yarn was first twisted in the S direction with a copper filament and then spun in the Z direction with a copper filament. The yarn was then knitted as in the Knitting Procedure and the resulting knit copper fabric passed the assessment. As noted above, FIG. 5 provides a photograph of an exemplary knit fabric, prepared according to Example 1. The knit fabric was placed in boiling water for one minute to remove the PVA load-carrying yarn. FIG. 3 provides a photograph of the exemplary knit fabric following removal of the load-carrying yarn, showing that no tarnish was left on the copper fabric. The same Yarn Manufacturing Procedure and Knitting Procedure as described for Example 1 were repeated, except using bamboo as the load-carrying yarn instead of PVA. The resulting knit copper fabric (with bamboo) passed the assessment.

Example 2

The yarn of Example 2 was prepared as in the Yarn Manufacturing Procedure, in which the load-carrying yarn was polyester yarn, except the load-carrying yarn was fed alongside the copper filament for twisting following the manufactures feeding diagram. This resulted in a twisted instead of wrapped yarn. The polyester yarn was first twisted in the S direction with a copper filament and then twisted in the Z direction with a copper filament. The yarn was knitted as in the Knitting Procedure and the resulting knit copper fabric passed the assessment. To remove the polyester, the knitted yarn was placed in a furnace at 375° C. for 2 hours. This removed the polyester and left a tarnish on the knit copper fabric. To remove this tarnish, the knit copper fabric was then placed in a solution of salt and white vinegar for 48 hours. The same Yarn Manufacturing Procedure and Knitting Procedure as described for Example 2 were repeated, except using bamboo as the load-carrying yarn instead of polyester. The resulting knit copper fabric passed the assessment.

Example 3

The yarn of Example 3 was prepared as in the Yarn Manufacturing Procedure, in which the load-carrying yarn was cotton yarn, except the load-carrying yarn was fed alongside the copper filament for twisting following the manufactures feeding diagram. This resulted in a twisted instead of wrapped yarn. The cotton yarn was first twisted in the S direction with a copper filament and then twisted in the Z direction with a copper filament. The yarn was knitted as in the Knitting Procedure and the resulting knit copper fabric passed the assessment. To remove the cotton, a flame was used to burn away the cotton. This removed the cotton and left a tarnish on the knit copper fabric. The tarnish was partially removed by soaking the knit copper fabric in a solution of salt and white vinegar for 48 hours. The same Yarn Manufacturing Procedure and Knitting Procedure as described for Example 3 were repeated, except using bamboo as the load-carrying yarn instead of cotton. The resulting knit copper fabric passed the assessment.

Example 4

The yarn of Example 4 was prepared as in the Yarn Manufacturing Procedure, except the wrapping process of a copper filament was repeated a 3rd time and then a 4th time around the PVA load-carrying yarn, alternating the twist direction between S and Z. The yarn was knitted as in the Knitting Procedure and the resulting knit copper fabric passed the assessment. The same Yarn Manufacturing Procedure and Knitting Procedure as described for Example 4 were repeated, except using bamboo as the load-carrying yarn instead of PVA. The resulting knit copper fabric passed the assessment.

Example 5

The yarn of Example 5 was prepared as in the Yarn Manufacturing Procedure, in which the load-carrying yarn was PVA yarn. The yarn was knitted as in the Knitting Procedure on the motorized knitting machine, except the knitting pattern consisted of rows that alternated between a plain knit and a rib knit. The resulting knit copper fabric passed the assessment. The same Yarn Manufacturing Procedure and Knitting Procedure as described for Example 5 were repeated, except using bamboo as the load-carrying yarn instead of PVA. The resulting knit copper fabric passed the assessment.

Example 6

The yarn of Example 6 was prepared as in the Yarn Manufacturing Procedure, in which the load-carrying yarn was PVA yarn. The yarn was knitted as in Example 5, except the rib stiches were replaced with tuck stiches and then the tucks were dropped from the bed opposite the main bed. The resulting knit copper fabric passed the assessment. The same Yarn Manufacturing Procedure and Knitting Procedure as described for Example 6 were repeated, except using bamboo as the load-carrying yarn instead of PVA. The resulting knit copper fabric passed the assessment.

Example 7

The yarn of Example 7 was prepared as in the Yarn Manufacturing Procedure, in which the load-carrying yarn was PVA yarn. The yarn was knitted as in the Knitting Procedure on the motorized knitting machine, except the knitting pattern was an interlock knit pattern consisting of two sheets knitted on opposite beds with a connecting layer of rib knitted loops between them. The resulting knit copper fabric passed the assessment. The same Yarn Manufacturing Procedure and Knitting Procedure as described for Example 7 were repeated, except using bamboo as the load-carrying yarn instead of PVA. The resulting knit copper fabric passed the assessment.

Example 8

The yarn of Example 8 was prepared as in the Yarn Manufacturing Procedure, in which the load-carrying yarn was PVA yarn. The yarn was knitted as in the Knitting Procedure on the motorized knitting machine as in Example 7, except in a pattern of a spacer fabric that consisted of two plain knitted sheets connected by a tucked layer. The resulting knit copper fabric passed the assessment. The same Yarn Manufacturing Procedure and Knitting Procedure as described for Example 8 were repeated, except using bamboo as the load-carrying yarn instead of PVA. The resulting knit copper fabric passed the assessment.

Example 9

The yarn of Example 9 was prepared as in the Yarn Manufacturing Procedure, in which the load-carrying yarn was PVA yarn. The yarn was knitted as in the Knitting Procedure on the motorized knitting machine as in Example 7, except a tube was formed instead of the two plain knitted sheets. The resulting knit copper fabric passed the assessment. The same Yarn Manufacturing Procedure and Knitting Procedure as described for Example 9 were repeated, except using bamboo as the load-carrying yarn instead of PVA. The resulting knit copper fabric passed the assessment.

Comparative Example 1

Instead of twisting of a load-carrying yarn and a copper filament as described in the Yarn Manufacturing Procedure, a single copper filament was knitted on the on the hand driven knitting machine as a plain knit at least 15 needles wide. The resulting knit had numerous broken loops and thus failed the assessment. A 1×1 rib knit of single copper filament at least 15 needles wide was knitted with numerous broken loops. The same was tried with a single copper filament on the motorized knitting machine as both a plain knit and a 1×1 rib knit, at least 15 loops wide, without success.

Comparative Example 2

Instead of preparing a yarn according to the Yarn Manufacturing Procedure, the wrapping procedure was bypassed and the knitting was attempted by feeding a bamboo yarn through the same feeder as a copper filament. This combination was then knitted using the hand knitting machine, resulting in a knitted textile with many broken copper strands and thus failed the assessment.

All cited references, patents, and patent applications in the above application for letters patent are herein incorporated by reference in their entirety in a consistent manner. In the event of inconsistencies or contradictions between portions of the incorporated references and this application, the information in the preceding description shall control. The preceding description, given in order to enable one of ordinary skill in the art to practice the claimed disclosure, is not to be construed as limiting the scope of the disclosure, which is defined by the claims and all equivalents thereto.

What is claimed is:

1. A knit fabric comprising at least one continuous copper filament formed into a knit fabric, the knit fabric comprising:

a) a layer of knit copper fabric having a first major plane, wherein the fabric has 5 to 18 loops per inch; and b) at least one loop of copper filament extending out of the first major plane such that the loop of copper filament and the first major plane of the knit copper fabric form an angle between 15 and 165 degrees.

2. The knit fabric of claim 1, wherein the copper filament has a diameter of 0.063 millimeters (42 gauge) to 0.32 millimeters (28 gauge), inclusive.

3. The knit fabric of claim 1, wherein the copper filament is twisted around a yarn that exhibits a minimum bend radius that wraps around an object having a diameter of 0.43 millimeters.

4. The knit fabric of claim 3, wherein the yarn comprises nylon, polyester, polyvinyl alcohol (PVA), cotton, bamboo, wool, aramid, spandex, or a combination thereof.

5. The knit fabric of claim 1, wherein the copper filament is twisted around a second continuous copper filament in a first direction and the twisted copper filaments are further twisted in a second, opposing, direction around at least a third continuous copper filament to form a filament bundle.

6. The knit fabric of claim 1, further comprising a second layer of knit copper fabric attached to the first layer of knit copper fabric attached by the at least one continuous copper filament.

7. The knit fabric of claim 1, exhibiting a thermal conductivity of 0.5 W/m*K or greater.

8. The knit fabric of claim 1, wherein the at least one loop of copper filament extending out of the first major plane comprises a plurality of loops.

9. The knit fabric of claim 1, wherein the at least one loop of copper filament extending out of the first major plane extends across a plurality of loops of the layer of knit copper fabric.

10. The knit fabric of claim 1, wherein the at least one loop of copper filament extending out of the first major plane comprises a crimped shape along a length of the at least one loop.

11. The knit fabric of claim 1, comprising at least two loops of copper filament extending out of the first major plane that are knitted together.

12. A knit fabric comprising a spacer fabric knit comprising a first layer of knit copper fabric interconnected with a second layer of knit copper fabric, wherein the first layer of knit copper fabric comprises at least two continuous copper filament paths.

13. The knit fabric of claim 12, wherein the first second layer of knit copper fabric comprises at least two continuous copper filament paths.

14. The knit fabric of claim 13, wherein the first layer of knit copper fabric is interconnected with a second layer of knit copper fabric via a tucked layer.

15. A method of making a knit fabric, the method comprising:

a) twisting or wrapping at least one continuous copper filament with a load-carrying yarn, wherein the load-carrying yarn exhibits a minimum bend radius that wraps around an object having a diameter of 0.43 millimeters;

b) setting at least one tension setting on a knitting machine; and c) using a knitting program that defines a plurality of stitch settings, knitting a fabric comprising:

i) a layer of knit copper fabric having a first major plane wherein the fabric has 5 to 18 loops per inch; and ii) at least one loop of copper filament extending out of the first major plane such that the loop of copper filament and the first major plane of the knit copper fabric form an angle between 15 and 165 degrees.

16. The method of claim 15, further comprising removing the load-carrying yarn.

17. The method of claim 16, wherein the load-carrying yarn is removed using at least one of heat, flame, or solvent.

18. The method of claim 15, wherein the copper filament and the load-carrying yarn are fed through a yarn twister to wrap the copper filament around the load-carrying yarn in the S direction or Z direction at between 4 twists per meter and 750 twists per meter, thereby providing a combined load-carrying yarn and copper filament.

19. A method of making a knit fabric, the method comprising:

a) twisting or wrapping at least one continuous copper filament with a load-carrying yarn, wherein the load-carrying yarn exhibits a minimum bend radius that wraps around an object having a diameter of 0.43 millimeters;

b) setting at least one tension setting on a knitting machine; and c) using a knitting program that defines a plurality of stitch settings, knitting a fabric comprising either:

i) an interlock knit pattern consisting of two layers knitted on opposite beds with a connecting layer of rib knitted loops between them, or ii) a spacer fabric that comprises two knitted layers connected by a tucked layer.

* * * * *